US008469016B2

(12) United States Patent
Plaskett

(10) Patent No.: US 8,469,016 B2
(45) Date of Patent: Jun. 25, 2013

(54) ROTARY STONE CUTTING METHOD

(71) Applicant: C.M.S.-North America, Inc., Caledonia, MI (US)

(72) Inventor: Jonathan A. Plaskett, Simi Valley, CA (US)

(73) Assignee: C.M.S.—North America, Inc., Caledonia, MI (US)

( * ) Notice: Subject to any disclaimer, the term of this patent is extended or adjusted under 35 U.S.C. 154(b) by 0 days.

(21) Appl. No.: 13/675,086

(22) Filed: Nov. 13, 2012

(65) Prior Publication Data

US 2013/0098347 A1 Apr. 25, 2013

Related U.S. Application Data

(62) Division of application No. 12/460,617, filed on Jul. 22, 2009, now Pat. No. 8,353,278.

(51) Int. Cl.
*B28D 1/04* (2006.01)

(52) U.S. Cl.
USPC ..... 125/13.02; 125/13.01; 125/15

(58) Field of Classification Search
USPC . 29/897.3, 557, 558; 83/929, 953; 125/13.01, 125/13.02, 15, 18, 22; 451/461; 700/159, 700/183
See application file for complete search history.

(56) References Cited

U.S. PATENT DOCUMENTS

| | | | | |
|---|---|---|---|---|
| 1,830,971 | A | 11/1931 | Taylor | |
| 2,187,299 | A | 1/1940 | Burkhardt | |
| 2,877,105 | A | 3/1959 | Smith | |
| 3,290,834 | A | 12/1966 | Lindblad | |
| 3,431,687 | A | 3/1969 | Fischer et al. | |
| 3,896,593 | A | 7/1975 | Rine | |
| 4,246,004 | A | 1/1981 | Busch et al. | |
| 4,492,059 | A | 1/1985 | Panetti | |
| 4,827,675 | A | 5/1989 | Andrews | |
| 5,052,153 | A | 10/1991 | Wiand | |
| 5,259,148 | A | 11/1993 | Wiand | |
| 5,885,149 | A | 3/1999 | Gillet et al. | |
| 5,911,620 | A | 6/1999 | Spangenberg et al. | |
| 6,033,295 | A | 3/2000 | Fiser et al. | |
| 6,390,900 | B1 | 5/2002 | Susnjara | |
| 6,712,061 | B1 | 3/2004 | Kalb | |
| 6,932,075 | B1 | 8/2005 | Tsao | |
| 7,198,042 | B2 | 4/2007 | Harris | |
| 7,204,244 | B1 * | 4/2007 | Pedersen | 125/20 |
| 7,229,342 | B1 | 6/2007 | York | |
| 7,489,984 | B2 | 2/2009 | Jackman et al. | |
| 2005/0281612 | A1 | 12/2005 | Boone | |
| 2006/0135041 | A1 | 6/2006 | Boone et al. | |
| 2006/0150576 | A1 | 7/2006 | Boone | |
| 2007/0282718 | A1 | 12/2007 | Morgan et al. | |

* cited by examiner

*Primary Examiner* — Timothy V Eley
(74) *Attorney, Agent, or Firm* — Price Heneveld LLP

(57) ABSTRACT

A rotary stone cutting tool and method for making countertops and the like includes a shank shaped for detachable connection with a rotary drive. A cup-shaped cutting blade is mounted on the outer end of the shank, and has a frustoconical sidewall and an outer marginal edge with axially protruding cutting teeth. A plurality of cutting pads are embedded in the sidewall and protrude radially outwardly therefrom. The blade is advanced through a stone slab with the sidewall oriented generally perpendicular to the face of the stone slab to cut an arcuate portion of an inside corner with reduced waste.

29 Claims, 7 Drawing Sheets

ROTARY STONE CUTTING METHOD

BACKGROUND OF THE INVENTION

The present invention relates to stone cutting technology, and in particular to a rotary stone cutting tool and method for making countertops, work surfaces, tabletops and the like.

Natural and synthetic stone veneers, such as granite, marble, cambria quartz, Silestone® and the like, are used to make building floors and facades, as well as tabletops, work surfaces, furniture tops, kitchen countertops and other similar products. Typically, the stone veneer is fabricated in very large slabs from which a plurality of individual pieces must be cut to size and shape. For many countertop applications, the stone slabs often average five to ten feet in length and width, and are two to three centimeters thick, although a wide variety of different sizes and thicknesses are also available. Thus, the stone slabs from which finished countertop products are made are quite large, heavy, difficult to handle and expensive.

To make a stone countertop, a workman typically goes to the jobsite to make a template. Since building walls are not perfectly square or straight and the cabinets on which the countertop is placed are not always aligned with the original plan, the template recreates the irregularities, so that the countertop can be fit properly. The objective is that the finished countertop can then be used without significant modification on the jobsite. The template is brought back to the manufacturing shop where the shape is traced onto a stone slab. Alternatively, the dimensions obtained at the jobsite can be input into software associated with a computer numerical control (CNC) machine. The desired countertop pieces are then cut from the raw stone slab using circular saws, rotor-type cutting tools, water jet machines and the like.

Prior art stone cutting systems are commonly complicated in construction, expensive to purchase and time-consuming to use. Heretofore, problems have particularly existed in the formation of interior corners in angled or L-shaped countertops, in a quick and easy manner, without experiencing substantial waste. While water jet cutters can be used to form the arcuate interior corners of an angled countertop, the process is relatively slow, costly, messy, and uses abrasive powder or the like, which can damage the CNC machine. Other prior art cutting devices tend to waste a substantial amount of stone veneer material at the corner, which increases the overall cost of production.

SUMMARY OF THE INVENTION

One aspect of the present invention is a rotary stone cutting tool for making countertops and the like having a rigid cutting tool shank with an outer end and an inner end configured for detachable mounting in an associated rotary drive. A flat circularly-shaped saw blade is operably connected with the shank for rotation therewith, and is configured to make mutually angled straight cuts through a generally flat face of a stationary stone slab when the stone cutting tool is in a first angular position to define straight portions of an inside corner in the stone slab. A cup-shaped cutting blade is fixedly connected with the outer end of the shank for rotation therewith, and is configured to make an arcuate cut through the stone slab when the stone cutting tool is in a second angular position. The cup-shaped cutting blade has a frusto-conical sidewall, which is inclined radially outwardly from the shank, and includes an outer marginal edge with a plurality of axially protruding cutting teeth. The cup-shaped cutting blade also includes a plurality of cutting pads embedded in the sidewall and protruding radially outwardly therefrom, such that the stone cutting tool is advanced into and through the stone slab in the second angular position with the sidewall oriented generally perpendicular to the face of the stone slab to cut an arcuate portion of the inside corner therein with reduced waste.

Another aspect of the present invention is an apparatus for making stone countertops and the like having a rotary drive adapted for axially rotating an associated tool with respect to a stationary stone slab having at least one generally flat face, and being shiftable between first and second angular positions relative to the face of the stone slab. The apparatus also includes a stone cutting tool having a rigid cutting tool shank with an outer end and an inner end detachably mounted in the rotary drive and rotating axially therewith. A flat circularly-shaped saw blade is operably connected with the shank for rotation therewith, and is configured to make mutually angled straight cuts through the stone slab when the rotary drive is in the first angular position to define straight portions of an inside corner in the stone slab. A cup-shaped cutting blade is fixedly connected with the outer end of the shank for rotation therewith, and is configured to make an arcuate cut through the stone slab when the rotary drive is in a second angular position. The cup-shaped cutting blade has a frusto-conical sidewall, which is inclined radially outwardly from the shank, and includes an outer marginal edge with a plurality of axially protruding teeth, and a plurality of cutting pads embedded in the sidewall and protruding radially outwardly therefrom, such that the stone cutting tool is advanced into and through the stone slab in the second angular position with the sidewall oriented generally perpendicular to the face of the stone slab to cut an arcuate portion of the inside corner therein with reduced waste.

Yet another aspect of the present invention is a rotary stone cutting tool for making countertops and the like having a rigid cutting tool shank with an outer end and an inner end configured for detachable mounting in the rotary drive. A cup-shaped cutting blade is fixedly connected with the outer end of the shank for rotation therewith, and is configured to make an arcuate cut through the inside corner of the stone slab. The cup-shaped cutting blade has a frusto-conical sidewall, which is inclined radially outwardly from the shank, and includes an outer marginal edge with a plurality of axially protruding cutting teeth. The cup-shaped cutting blade also has a plurality of cutting pads embedded in the sidewall and protruding radially outwardly therefrom, such that the stone cutting tool is advanced into and through the stone slab with the sidewall oriented generally perpendicular to the face of the stone slab to cut an arcuate portion of the inside corner therein with reduced waste.

Yet another aspect of the present invention is a method for making stone countertops and the like including the step of providing a rotary drive adapted for axially rotating an associated tool with respect to a stationary stone slab having at least one generally flat face, and being shiftable between first and second angular positions relative to the face of the stone slab. The method also includes the steps of fabricating a rigid cutting tool shank having an outer end and an inner end adapted for detachable mounting in the rotary drive, and operably connecting a flat circularly-shaped saw blade with the shank for rotation therewith. The method also includes fabricating a cup-shaped cutting blade configured to make an arcuate cut through the stone slab when the rotary drive is in the second angular position. The cup-shaped cutting blade has a frusto-conical sidewall, which is inclined radially outwardly from the shank, an outer marginal edge with a plurality of axially protruding cutting teeth, and a plurality of cutting pads embedded in the sidewall and protruding radially outwardly therefrom. The method also includes the steps of fixedly mounting the cup-shaped cutting blade on the outer end of the shank, and detachably mounting the inner end of the shank in the rotary drive for rotation therewith. The method further includes the steps of shifting the rotary drive to the first angular position and sequentially cutting two mutually angled straight cuts through the stone slab to define straight portions of an inside corner in the stone slab. The method further includes the steps of shifting the rotary drive to the second angular position at a location generally aligned with the intersection point of the mutually angled straight cuts, and advancing the cup-shaped cutting blade into and through the stone slab with the sidewall oriented generally perpendicular to the face of the stone slab to cut an arcuate portion of the inside corner therein with reduced waste.

Yet another aspect of the present invention is an improved method for making stone countertops and the like using an articulated rotary drive adapted for axially rotating an associated tool with respect to a stationary stone slab. The improved method includes fabricating a cutting tool shank with an outer end and an inner end shaped for detachable mounting in the rotary drive and rotating axially therewith. The improved method also includes the step of fabricating a cup-shaped cutting blade configured to make arcuate cuts through the stone slab, and having a frusto-conical sidewall, which is inclined radially outwardly from the shank, an outer marginal edge with a plurality of axially protruding cutting teeth, and a plurality of cutting pads embedded in the sidewall and protruding radially outwardly therefrom. The improved method also includes the steps of fixedly mounting the cup-shaped cutting blade on the outer end of the shank, and sequentially forming two mutually angled straight cuts through the stone slab to define straight portions of an inside corner in the stone slab. The improved method further includes the steps of detachably mounting the inner end of the shank in the rotary drive for rotation therewith, shifting the cup-shaped cutting blade to a location generally aligned with the intersection point of the mutually angled straight cuts, and advancing the cup-shaped cutting blade into and through the stone slab with the sidewall oriented generally perpendicular to the face of the stone slab to cut an arcuate portion of the inside corner therein with reduced waste.

Yet another aspect of the present invention is a rotary stone cutting tool and method which is relatively inexpensive to manufacture and easy to use. The cutting tool cuts quickly and accurately through even thick stone slabs, and is configured so as to minimize waste, thereby reducing overall manufacturing costs. The rotary stone cutting tool is efficient in use, capable of a long operating life and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
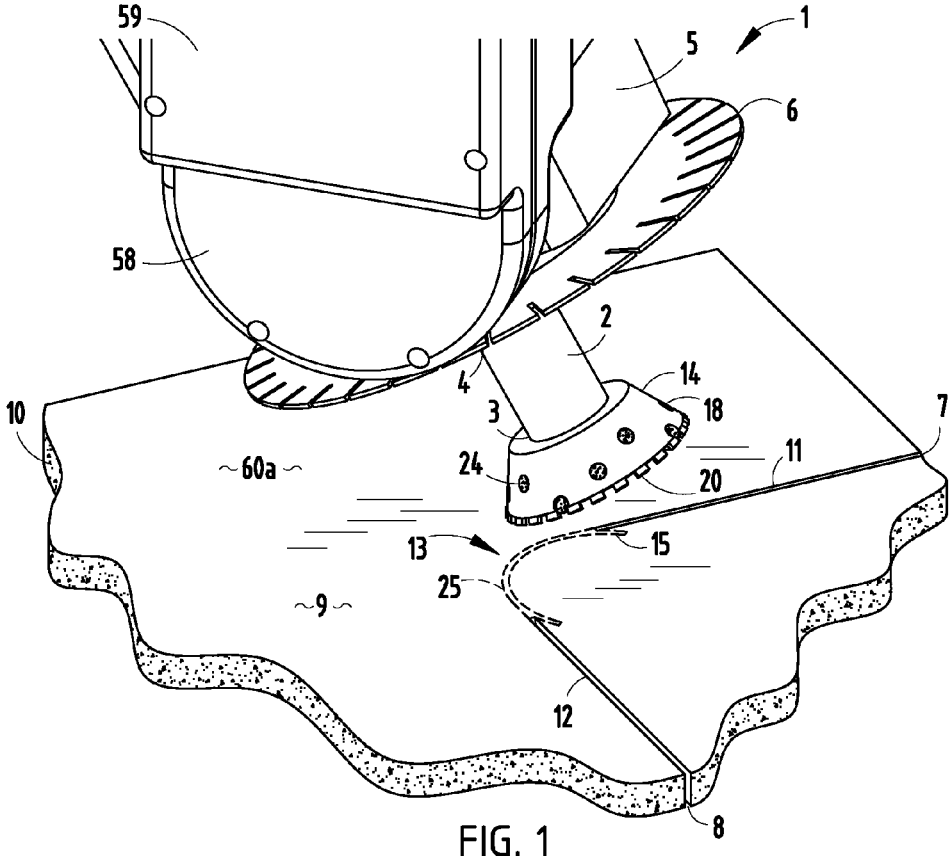
FIG. 1 is a perspective view of a rotary stone cutting tool embodying the present invention, shown making an inside corner of a countertop.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1 and 2) generally designates a rotary stone cutting tool for making countertops and the like, embodying the present invention. Rotary stone cutting tool 1 includes a rigid cutting tool shank 2 with an outer end 3 and an inner end 4 configured for detachable mounting in an associated rotary motor or drive 5. A flat circularly-shaped saw blade 6 is operably connected with the shank 2 for rotation therewith, and is configured to make mutually angled straight cuts 7 and 8 through a generally flat face 9 of a stationary stone slab 10 when the stone cutting tool 1 is in a first angular position (FIGS. 12 and 13) to define straight portions 11 and 12 of an inside corner 13 in the stone slab 10. A hollow cone or cup-shaped cutting blade 14 is fixedly connected with the outer end 3 of the shank 2 for rotation therewith, and is configured to make an arcuate cut 15 through the stone slab 10 when the stone cutting tool 1 is in a second angular position (FIGS. 1, 14, and 15). The cup-shaped cutting blade 14 has a frusto-conical sidewall 18, which is inclined radially outwardly from shank 2, and includes an outer marginal edge 19 with a plurality of axially protruding cutting teeth 20. A plurality of cutting pads 24 are embedded in the sidewall 18 and protrude radially outwardly therefrom. The stone cutting tool 1 is advanced into and through the stone slab 10 in the second angular position (FIGS. 1, 14, and 15) with the sidewall 18 oriented generally perpendicular to the face 9 of the stone slab 10 to cut an arcuate portion 25 of the inside corner 13 therein with reduced waste.

Figure 2:
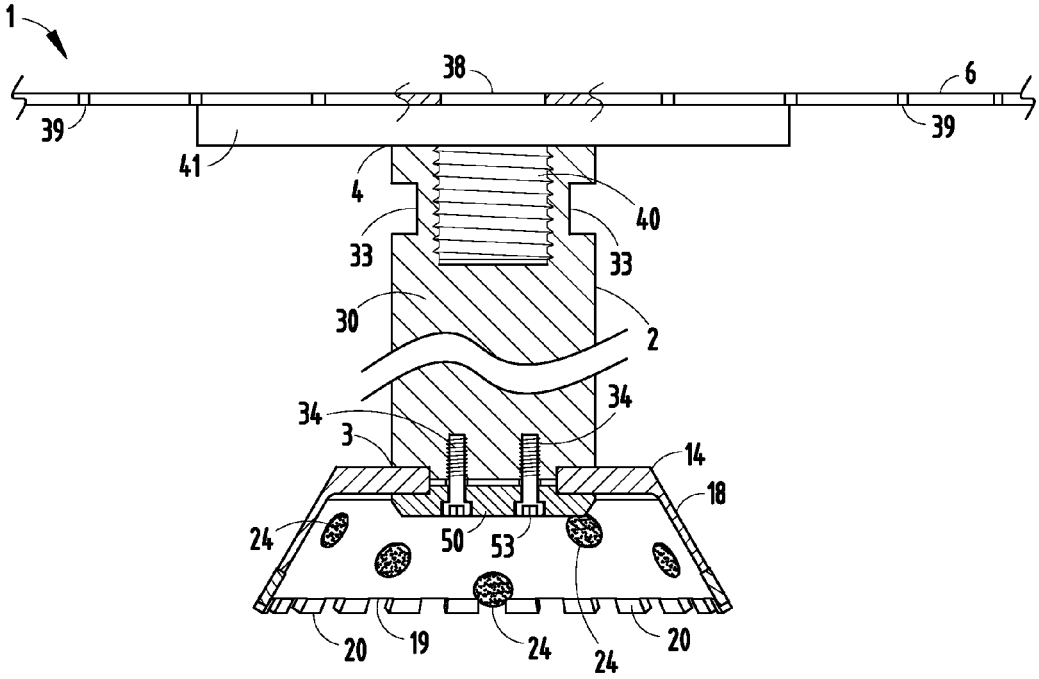
FIG. 2 is a side elevational view of the rotary stone cutting tool, wherein portions thereof have been broken away to reveal internal construction.
Figure 3:
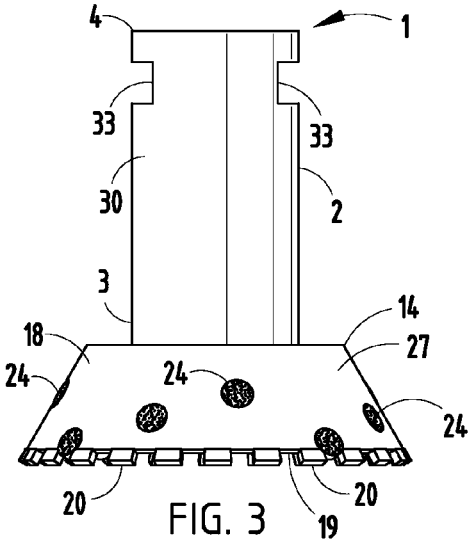
FIG. 3 is a side elevational view of the rotary stone cutting tool.
Figure 4:
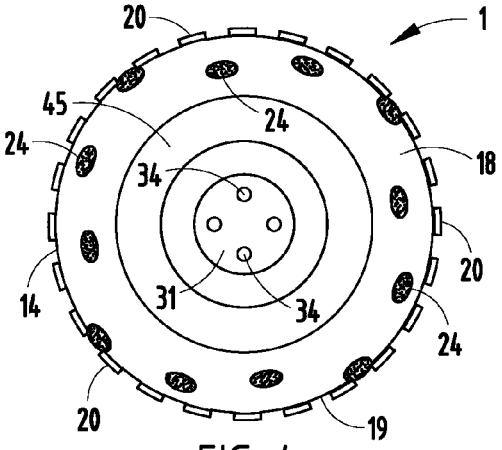
FIG. 4 is a bottom plan view of the rotary stone cutting tool, with portions thereof removed to reveal internal construction.

With reference to FIGS. 2-5, the illustrated shank 2 is in the nature of a tool extension, and comprises a generally cylindrical body 30, wherein the outer end 3 includes an axially protruding shoulder 31, and the inner end 4 is flat, and includes an internally threaded, axially extending mounting aperture 32. The sidewall of body 30 includes two parallel, mutually opposed channels or flats 33, which facilitate assembly and mounting of rotary stone cutting tool 1 in rotary drive 5. As best illustrated in FIG. 2, the outer end 3 of shank 2 includes four axially extending, laterally spaced apart threaded apertures 34, which facilitate attaching cup-shaped blade 14 thereto in the manner described in greater detail below. In one working embodiment of the present invention, shank 2 is fabricated from stainless steel, or other like material.

In the illustrated example, flat circular saw blade 6 has a generally conventional construction, with a center mounting hole 38 and a plurality of cutting teeth 39 formed in the circumferential edge of blade 6. In the example illustrated in FIG. 2, a threaded spindle portion 40 of rotary drive 5 extends through the central mounting hole 38 in circular blade 6, through a mating central aperture in a disk-shaped retainer plate 41, and is threadedly engaged in the internal threaded aperture 32 in the inner end 4 of shank 2, such that circular blade 6 and shank 2 are operably interconnected and rotate with rotary drive 5. The shank 2 serves to space circular cutting blade 6 axially from cup-shaped cutting blade 14 a predetermined distance sufficient to avoid interference when rotary stone cutting tool 1 is shifted between the first angular position (FIGS. 12 and 13) and the second angular position (FIGS. 1, 14, and 15).

Figure 5:
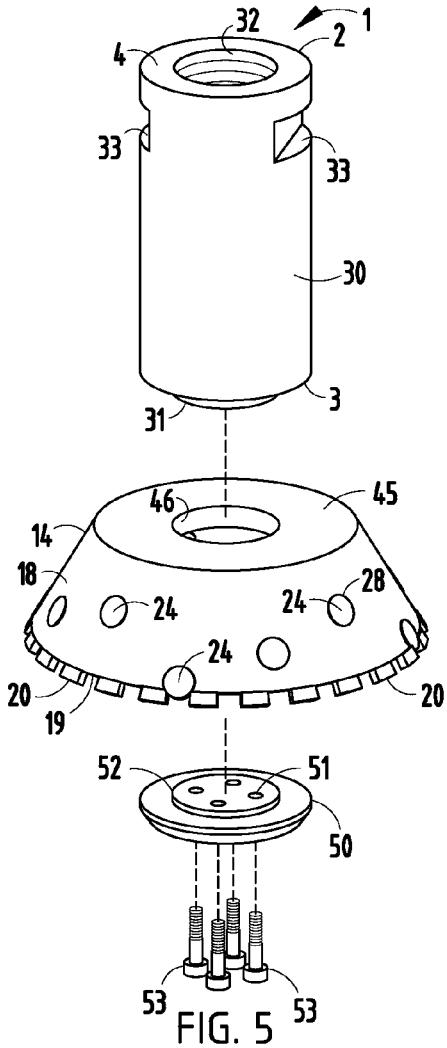
FIG. 5 is an exploded perspective view of the rotary stone cutting tool.
Figure 6:
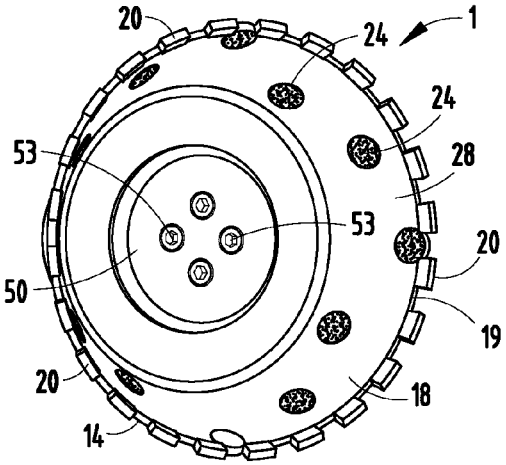
FIG. 6 is a perspective view of the rotary stone cutting tool taken from an interior portion thereof.
Figure 7:
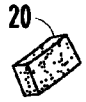
FIG. 7 is a perspective view of a cutting tooth, which is mounted on the marginal edge of the rotary stone cutting tool.
Figure 9:
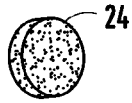
FIG. 9 is a perspective view of a cutting pad, which is embedded in the sidewall of the rotary stone cutting tool.
Figure 8:
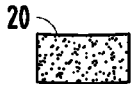
FIG. 8 is a plan view of the cutting tooth.
Figure 10:
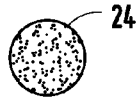
FIG. 10 is a plan view of the cutting pad.

With reference to FIGS. 2-10, the illustrated cup-shaped cutting blade 14 has a flat, annularly-shaped inner end 45 with a central aperture 46 in which the shoulder 31 of shank 2 is closely received, thereby precisely aligning cup-shaped blade 14 on shank 2. As best shown in FIGS. 5 and 6, a screw flange or retainer ring 50 is used to attach cup-shaped blade 14 to the outer end 3 of shank 2, and includes four axially extending, laterally spaced apart apertures 51 which are aligned with the apertures 34 in the outer end 3 of shank 2. Retainer ring 50 has a circular plan configuration, with an axially extending shoulder 52 on the inside surface thereof, which is closely received within the central aperture 46 of cup-shaped blade 14. A plurality of threaded fasteners 53 extend through the apertures 51 in retaining ring 50 and are anchored in the threaded apertures 34 in the outer end 3 of shank 2 to securely and accurately connect cup-shaped blade 14 with shank 2, yet permit disassembly for purposes of repair and/or replacement of worn parts.

With reference to FIGS. 2-10, the frusto-conically-shaped sidewall 18 of cup-shaped blade 14 defines a hollow, cone-like interior 56 that permits the marginal edge 19 with cutting teeth 20 thereon to advance through the stone slab 10 to define the arcuate portion 25 of inside corner 13, with minimal waste of stone slab 10. In the illustrated example, sidewall 18 is made from a relatively mild steel, and the cutting teeth 20 comprise a plurality of composite inserts that are fixedly mounted along the outer marginal edge 19 of sidewall 18 in a circumferentially spaced apart fashion. Each illustrated cutting tooth 20 has a generally rectangular prism shape with one of the long edges attached to the marginal edge 19 of sidewall 18 by brazing, silver soldering, or other similar attachment techniques. The cutting teeth 20 are oriented in a coplanar relationship with sidewall 18 and project both axially and radially outwardly. While cutting teeth 20 are originally in the shape of rectangular prisms, their side faces are ground or abraded into an arcuate shape after cutting through several countertops. The cutting teeth 20 are made from a composite material comprising a mixture of zinc, tin, diamond particles, and the like.

In the illustrated example, cutting pads 24 also comprise a plurality of composite inserts that are fixedly mounted in sidewall 18 in a circumferentially spaced apart relationship. In the illustrated example, cutting pads 24 protrude radially outwardly from the outside surface 27 of sidewall 18, and radially inwardly from the inside surface 26 of sidewall 18. Furthermore, the illustrated cutting pads 24 are disk-shaped with opposite circular flat faces arranged in a generally parallel relationship. Adjacent cutting pads 24 are arranged along sidewall 18 in an axially spaced apart relationship. While cutting pads 24 are originally in the shape of circular flat disks, their opposite faces are ground or abraded into an arcuate shape after cutting through several countertops. Like cutting teeth 20, cutting pads 24 are similarly constructed from a composite material comprising a mixture of zinc, tin, diamond particles, and the like. In one example of the present invention, circular holes 28 are formed in the tool sidewall 18 in a generally perpendicular relationship therewith, and the circular cutting pads 24 are closely received in each of the holes 28, and brazed or otherwise fixed in place. The sidewall 18 may also be provided with a plurality of through apertures (not shown) for distributing coolant to the areas of the stone slab 10 being cut.

Preferably, sidewall 18 is inclined at an angle in the range of 20 to 40 degrees relative to the central axis of rotation of shank 2 and cup-shaped blade 14. In one working embodiment of the present invention, sidewall 18 is angled at an angle of around 30 degrees relative to the axial axis of rotation of shank 2 and cup-shaped blade 14.

Figure 11:
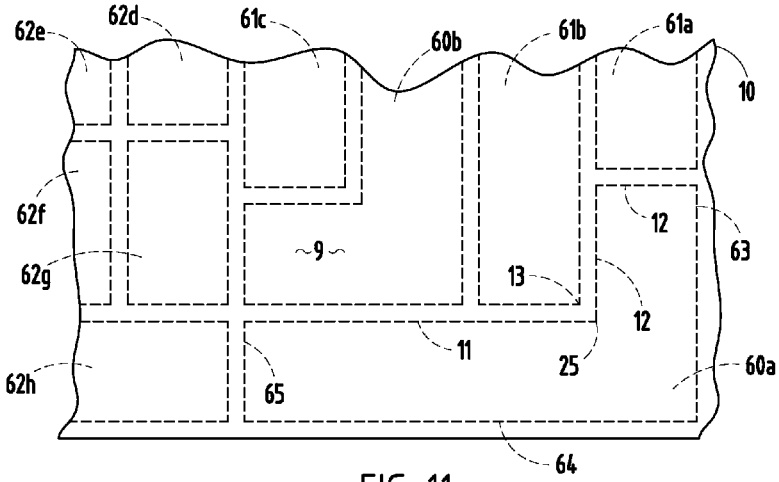
FIG. 11 is a partially schematic plan view of a large slab of stone veneer from which multiple countertop pieces are to be cut with reduced waste.

With reference to FIGS. 11-19, in one working embodiment of the present invention, rotary drive 5 is supported on a robot arm 59, which is controlled by a five axis computer numerical control (CNC) machine 59, which automatically shifts rotary stone cutting tool 1 relative to stone slab 10. The illustrated stone slab to be cut in FIG. 11 is large enough to form a plurality of individual countertops pieces, at least some of which have a different size and shape, such as the angled, L-shaped countertops 60*a* and 60*b*, and the straight countertops 61*a*-61*h*. Preferably, the specific dimensions of each of the countertop pieces 60*a*, 60*b* and 61*a*-61*h* are input into software which computes the most efficient way to form the countertops with minimum waste using rotary stone cutting tool 1.

Figure 12:
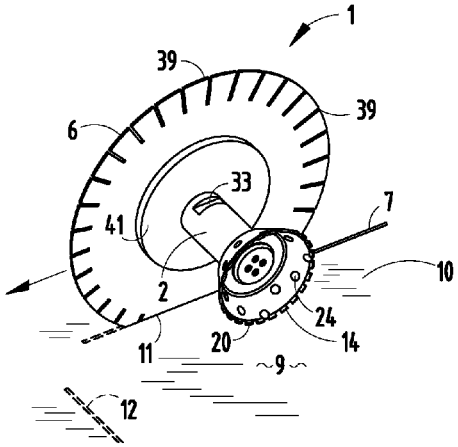
FIG. 12 is a partially schematic perspective view of the rotary stone cutting tool, shown in a first angular position, and making a first straight cut through the face of the stone slab to define a first straight portion of an inside corner in the stone slab.
Figure 13:
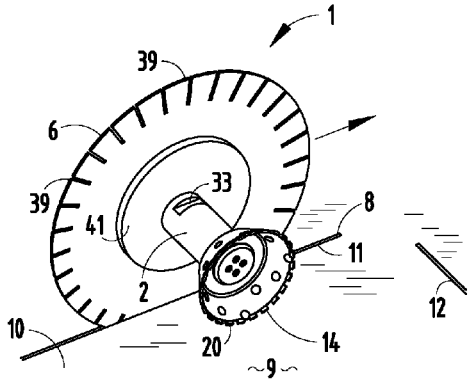
FIG. 13 is a partially schematic perspective view of the rotary stone cutting tool, shown in the first angular position, and making a second straight cut through the face of the stone slab at an angle to the first cut to define a second straight portion of an inside corner in the stone slab.
Figure 14:
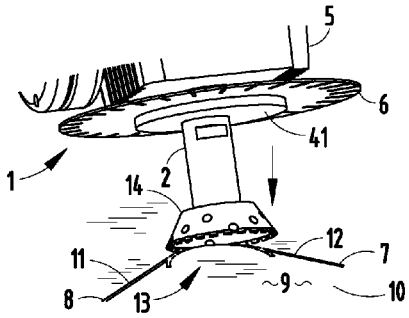
FIG. 14 is a partially schematic perspective view of the rotary stone cutting tool, shown in a second angular position with the cup-shaped cutting blade located generally above the intersection point of the mutually aligned straight cuts, and advancing into the stone slab with the sidewall oriented generally perpendicular to the face of the stone slab to make an arcuate portion of the inside corner.
Figure 15:
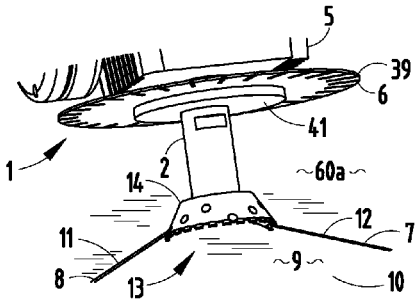
FIG. 15 is a partially schematic perspective view of the rotary stone cutting tool, shown completing the arcuate portion of the inside corner in the stone slab.
Figure 16:
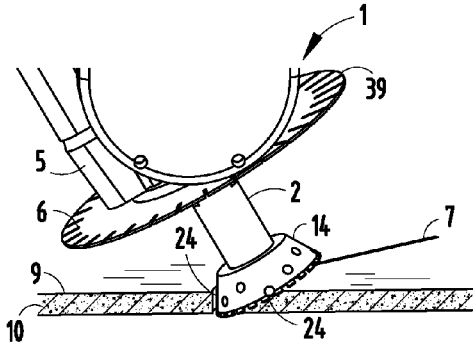
FIG. 16 is a partially schematic perspective view of the rotary stone cutting tool, shown completing the arcuate portion of the inside corner, wherein the stone slab has been broken away.
Figure 17:
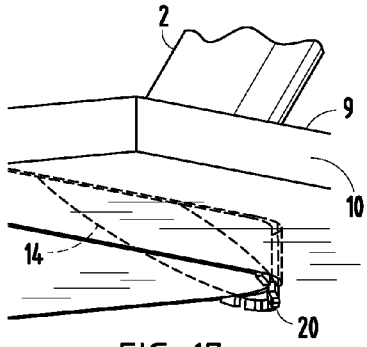
FIG. 17 is a partially schematic perspective view of the rotary stone cutting tool, shown completing the arcuate portion of the inside corner cut into the stone slab.
Figure 17A:
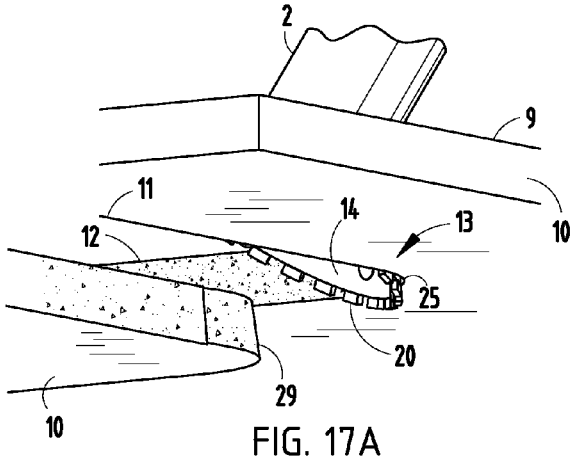
FIG. 17A is a partially schematic perspective view of the rotary stone cutting tool, shown after the inside corner has been cut, with the remaining portion of the slab separated from the cut countertop piece.
Figure 18:
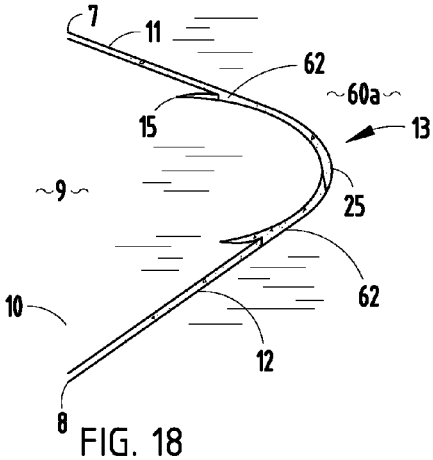
FIG. 18 is a partially schematic perspective view of the inside corner cut into the stone slab before the stone slab is separated.
Figure 19:
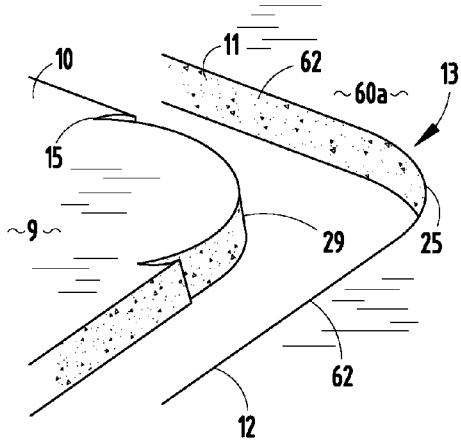
FIG. 19 is a partially schematic perspective view of the inside corner cut into the stone slab after the stone slab has been separated.
Figure 20:
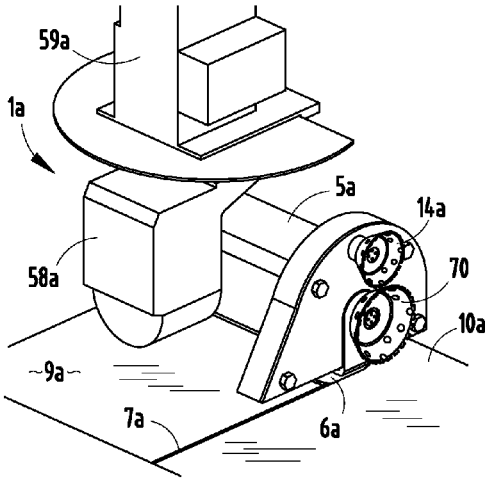
FIG. 20 is a partially schematic perspective view of another embodiment of the present invention, shown making a first straight cut through the flat face of a stationary stone slab.
Figure 21:
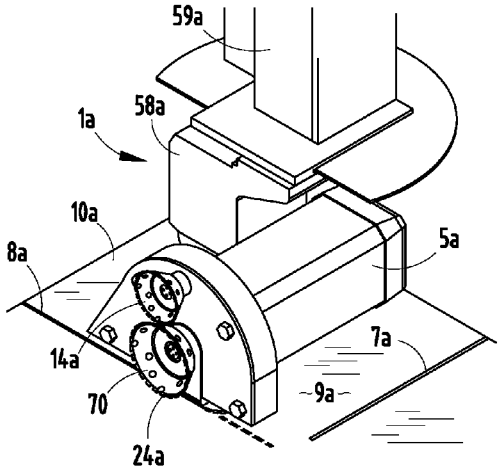
FIG. 21 is a partially schematic perspective view of the rotary stone cutting tool illustrated in FIG. 20, shown making a second straight cut through the flat face of a stationary stone slab.
Figure 22:
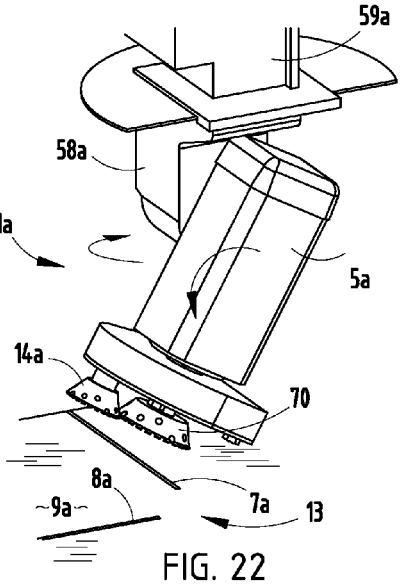
FIG. 22 is a partially schematic perspective view of the rotary stone cutting tool illustrated in FIGS. 20 and 21, shown with a large cup-shaped cutting blade located over the intersection point of the two mutually angled straight cuts.

With reference to FIGS. 11-19, in one working embodiment of the present invention, the angled or L-shaped countertop 60*a* with an inside corner 13 is rough cut from the large stone slab 10 (FIG. 11) in the following manner. Rotary drive 5 is shifted to the first angular position, wherein circularly-shaped saw blade 6 is disposed generally perpendicular to the face 9 of a stationary stone slab 10. As best illustrated in FIGS. 12 and 13, circular blade 6 is shifted in a direction parallel with the opposite faces 9 of stone slab 10 so as to form two mutually angled straight cuts 7 and 8 through the flat face 9 of stationary stone slab 10 to define the straight portions 11 and 12 of the inside corner 13 to be formed in stone slab 10. In one working embodiment of the present invention, stone slab 10 is retained in a stationary, horizontal orientation with the rotary drive 5 shifting both horizontally and vertically over the stationery stone slab 10 to form the individual countertop pieces 60*a*, 60*b* and 61*a*-61*h*. However, as will be appreciated by those skilled in the art, stone slab 10 may assume alternative orientations and/or may be shifted relative to a stationary cutting tool. In the example shown in FIGS. 11-19, the adjacent ends of straight cuts 7 and 8 are spaced apart so that the countertop 60*a* remains connected with stone slab 10. Rotary drive 5 is then pivoted or rotated approximately 60 degrees along a vertical plane to the second angular position (FIGS. 1, 14, and 15), which orients the sidewall 18 of cup-shaped cutting blade 14 generally perpendicular to the face 9 of stone slab 10. Rotary drive 5 is positioned directly above the intersection point of the mutually angled straight cuts 7 and 8, and then is advanced vertically into and through the stone slab 10 to cut the arcuate portion 25 of inside corner 13. As best illustrated in FIGS. 17A-19, the vertical plunge cut of cup-shaped cutting blade 14 is quick and accurate, and defines an elliptical cut line in the upper face 9 of stone slab 10. Due to the hollow, frusto-conical shape of sidewall 18, most of the stone slab material adjacent to the two straight cuts 7 and 8 is not wasted. Consequently, the various countertop pieces 60*a*, 60*b* and 61*a*-61*h* can be nested tightly together on stone slab 10 to maximize efficiency and economy of manufacture. As best illustrated in FIGS. 17A and 19, as well as FIGS. 23A and 25 which are discussed below, when cup-shaped blade 14 cuts through stone slab 10 forming the arcuate cut 15, the inside edge 25 on countertop 60*a* is vertical and straight, while the opposite or outside edge 29 on the remaining portion of stone slab 10 is angled. After the leading edge of the cup-shaped cutting blade protrudes through the bottom face of the stone slab, as shown in FIGS. 15-17, the rotary drive 5 may be shifted or oscillated a short distance away from the arcuate corner along straight cuts 7 and 8 to finish or smooth out the transition areas 62 (FIGS. 17A-19) between the straight portions 11 and 12 of inside corner 13 and the arcuate portion 25 of inside corner 13. Since rotary stone cutting tool 1 simply rough cuts countertop 60*a* from stone slab 10, when the cut countertop edges are subsequently finish formed into one of a variety of different shapes, it may not be necessary to finish or smooth the transition areas 62, since this is automatically accomplished in the various edge finishing operations. The remaining straight edges 63-66 of countertop 60*a* can be cut with circular blade 6 either before or after the formation of inside corner 13.

The reference numeral 1*a* (FIGS. 20-30) generally designates another embodiment of the present invention having two cup-shaped blades that form the inside corner of an associated angled or L-shaped countertop. Since rotary stone cutting tool 1*a* is similar to the previously described rotary stone cutting tool 1, similarly parts appearing in FIGS. 1-19 and FIGS. 20-30, respectively, are represented by the same, corresponding reference numerals, except for the suffix "a" in the numerals of the latter.

Figure 23:
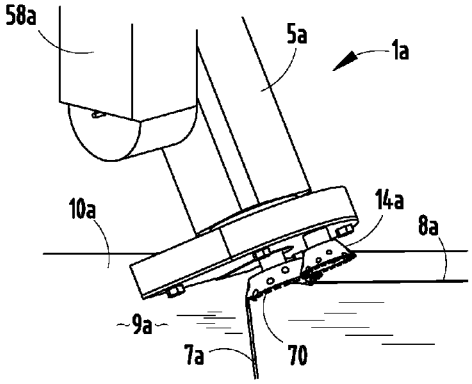
FIG. 23 is a partially schematic perspective view of the rotary stone cutting tool illustrated in FIGS. 20-22, shown with a large cup-shaped cutting blade making an arcuate portion of the inside corner in the stone slab.
Figure 23A:
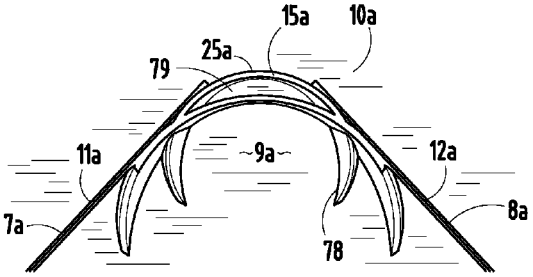
FIG. 23A is a fragmentary partially schematic plan view of the inside corner cut into the stone slab.
Figure 24:
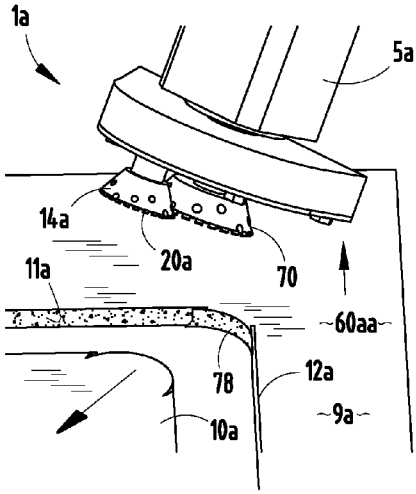
FIG. 24 is a fragmentary perspective view of the cut inside corner shown in FIG. 23, with the stone slab separated.
Figure 25:
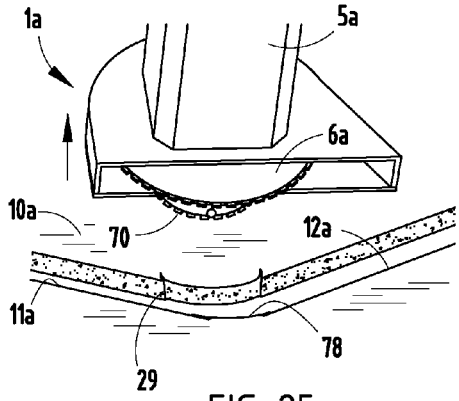
FIG. 25 is another fragmentary perspective view of the cut inside corner shown in FIG. 23, with the stone slab separated.
Figure 26:
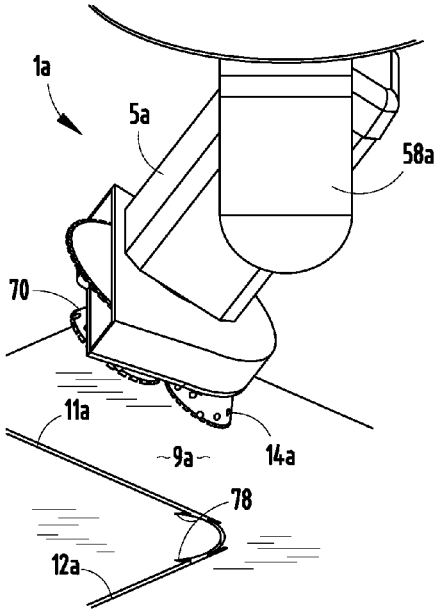
FIG. 26 is a partially schematic perspective view of the rotary stone cutting tool illustrated in FIGS. 20-25, shown with a small cup-shaped cutting blade being rotated into position over the intersection point of the two mutually angled straight cuts.
Figure 27:
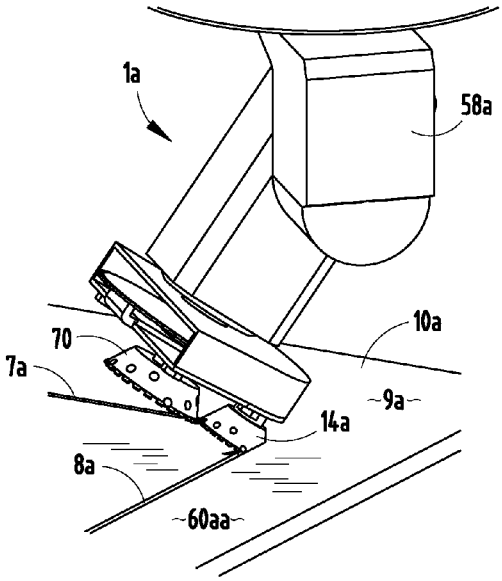
FIG. 27 is a partially schematic side perspective view of the rotary stone cutting tool illustrated in FIGS. 20-26, shown with the small cup-shaped cutting blade completing the arcuate portion of the inside corner in the stone slab.
Figure 28:
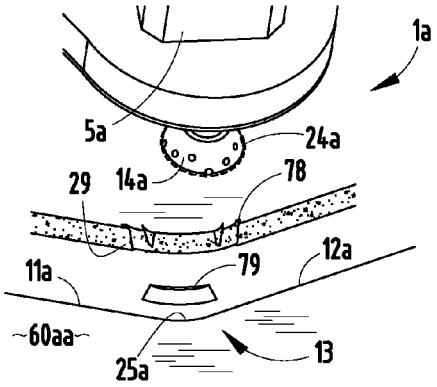
FIG. 28 is a fragmentary perspective view of the completed cut inside corner shown in FIG. 27, with the stone slab separated.
Figure 29:
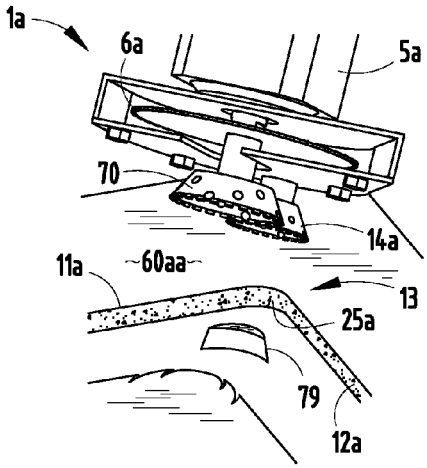
FIG. 29 is another fragmentary perspective view of the completed cut inside corner shown in FIG. 27, with the stone slab separated.
Figure 30:
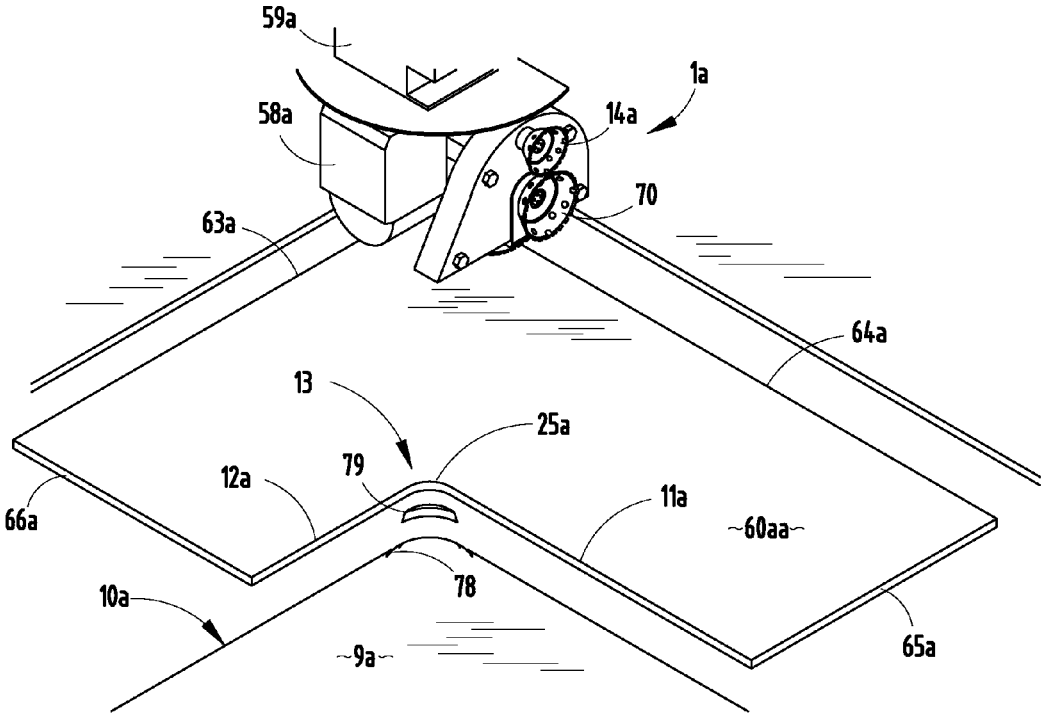
FIG. 30 is a partially schematic perspective view of the completed cut countertop made by the rotary stone cutting tool shown in FIGS. 20-29.

In rotary stone cutting tool 1*a*, a second cup-shaped blade 70 is mounted on and driven by rotary drive 5*a*, and is generally similar in construction to cup-shaped blade 14*a*, except that the diameter of cup-shaped blade 70 is larger than that of cup-shaped blade 14*a*, as measured at the marginal edge of the same. In the illustrated example, the sidewall 71 of the larger cup-shaped cutting blade is at an angle of around 30 degrees, similar to that of the smaller cup-shaped cutting blade 14*a*. Consequently, as best shown in FIGS. 23A and 25, when the larger cup-shaped blade 70 makes the first cut 78 through stone slab 10*a*, the inside edge on countertop 60*a* is vertical and straight, while the opposite or outside edge on the remaining portion of stone slab 10*a* is angled. In one embodiment of the rotary stone cutting tool 1*a*, the smaller cup-shaped cutting blade 14*a* has an outer marginal diameter of around 135-140 millimeters, while the larger cup-shaped cutting blade 70 has an outer marginal diameter of around 185-180 millimeters, with the sidewall thicknesses of both being around 4 millimeters. Preferably, both the larger and smaller cup-shaped cutting blades 70, 14*a* are powered by a common motor or rotary drive 5*a*, with one cutting blade having a direct drive, and the other cutting blade having a belt or shaft drive. Essentially, the smaller cup-shaped cutting blade 14*a* and the larger cup-shaped cutting blade 70 are shifted or rotated between operating cutting positions which form a portion of the inside corner, and non-operating home or storage positions above the surface of stone slab 10*a*.

More specifically, in the example illustrated in FIGS. 20-30, the straight portions 7*a* and 8*a* of inside corner 13*a* are formed in a substantially identical manner as the straight portions 11 and 12 described above, and as shown in FIGS. 20 and 21. However, the arcuate portion 25*a* of inside corner 13*a* is formed by using both the smaller cup-shaped blade 14*a* and the larger cup-shaped blade 70. More particularly, as shown in FIGS. 22-25, the larger cup-shaped blade 70 is shifted to the second angular position so that sidewall 71 is oriented perpendicular with the face 9*a* of stone slab 10*a* over the intersection of straight cuts 7*a* and 7*b*. The larger cup-shaped cutting blade 70 is then advanced into and through the face 9*a* of stone slab 10*a* to make an initial plunge cut 78 (FIG. 23A) through inside corner 13*a* of countertop 60*a* to interconnect portions of the two straight portions 11*a* and 12*a* of inside corner 13*a*. The larger cup-shaped blade 70 is then moved away from the stone slab 10*a*, and the smaller cup-shaped blade 14*a* is shifted to a position above the arcuate portion 25*a* of inside corner 13*a*. The smaller cup-shaped blade 14*a* is then advanced through the stone slab 10*a* at the intersection of straight portions 11*a* and 12*a*, thereby removing a crescent-shaped piece 79 (FIGS. 28-30) from stone slab 10*a*, and forming the finished inside corner 13*a* on countertop 60*a*. The use of two shiftable larger and smaller cup-shaped blades 70 and 14*a* forms neatly finished transition areas 62*a* between the straight cuts 7*a* and 7*b* and the arcuate cut 15*a*, in those applications desired, without the need for laterally shifting or oscillating the smaller cup-shaped blade 14*a* in the manner described above with respect to rotary stone cutting tool 1.

As will be appreciated by those skilled in the art, rotary stone cutting tools 1 and 1*a* may be used in conjunction with a wide variety of cutting machines, including those devices illustrated in FIGS. 1, 20-23 and 24-30. For example, rotary stone cutting tools 1 and 1*a* could be a part of a retrofit kit or factory upgrade for a conventional CNC saw which moves in the X, Y and Z axes, with a rotating table B axis. Other variations, such as those which use a tilting B axis table, a 60 degree gearbox, an electro spindle tool changer, or the like, are also possible.

It is also to be understood that while the rotary stone cutting tools 1 and 1*a* are described herein with respect to forming countertops and the like from large slabs of natural and/or engineered stone, the invention is equally applicable to the formation of individual pieces from large slabs of other hard materials, such as glass and the like. Also, rotary stone cutting tools 1 and 1*a* are particularly adapted to rough cut the countertop pieces 60*a*, 60*b*, and 61*a*-61*h* from stone slab 10, 10*a*. The cut edges can be later formed to various finished shapes, such as bullnose, beveled, flat ogee, cone dupont, and the like, through subsequent CNC profiling operations or the like.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method for making stone countertops and the like, comprising:

providing a rotary drive adapted for axially rotating an associated tool with respect to a stationary stone slab having at least one generally flat face, and being shiftable between first and second angular positions relative to the face of the stone slab;

fabricating a rigid cutting tool shank having an outer end thereof, and an inner end thereof shaped for detachable mounting in the rotary drive and rotating axially therewith;

operably connecting a flat circularly-shaped saw blade with the shank for rotation therewith;

fabricating a cup-shaped cutting blade configured to make an arcuate cut through the stone slab when the rotary drive is in the second angular position, with a frusto-conical sidewall which is inclined radially outwardly from the shank and includes an outer marginal edge with a plurality of axially protruding cutting teeth, and a plurality of cutting pads embedded in the sidewall and protruding radially outwardly from an outside surface of the sidewall and radially inwardly from an inside surface of the sidewall;

fixedly mounting the cup-shaped cutting blade on the outer end of the shank;

detachably mounting the inner end of the shank in the rotary drive for rotation therewith;

shifting the rotary drive to the first angular position and cutting two mutually angled straight cuts through the stone slab to define straight portions of an inside corner in the stone slab; and shifting the rotary drive to the second angular position at a location generally aligned with an intersection point of the mutually angled straight cuts, and advancing the cup-shaped cutting blade into and through the stone slab with the sidewall oriented generally perpendicular to the face of the stone slab to cut an arcuate portion of the inside corner therein with reduced waste.

2. A method as set forth in claim 1, including:

after said advancing the cup-shaped cutting blade step, linearly oscillating the cup-shaped cutting blade back and forth along the inside corner in the stone slab to ensure smooth transition areas between the straight portions and the arcuate portion of the inside corner.

3. A method as set forth in claim 2, including:

providing a computer numerical control (CNC) device, and operably connecting the CNC with the rotary drive to automatically shift the same relative to the stone slab between the first and second angular positions to form the inside corner in the stone slab.

4. A method as set forth in claim 3, including:

forming both of the mutually angled straight cuts in the stone slab before forming the arcuate portion of the inside corner.

5. A method as set forth in claim 4, including:

positioning the stone slab in a generally horizontal orientation during the formation of the straight and arcuate portions of the inside corner in the stone slab.

6. A method as set forth in claim 5, wherein:

said cup-shaped cutting blade shifting step comprises tilting the cup-shaped cutting blade around 30 degrees from the vertical to define the second angular position, and vertically moving the tilted cup-shaped cutting blade into and through the horizontal stone slab to define an arcuate plunge cut.

7. A method as set forth in claim 5, wherein:

said cup-shaped cutting blade advancing step comprises tilting the cup-shaped cutting blade around 30 degrees from the vertical, and vertically moving the tilted cup-shaped cutting blade into and through the horizontal stone slab to define an arcuate plunge cut.

8. A method as set forth in claim 1, including:

providing a computer numerical control (CNC) device, and operably connecting the CNC with the rotary drive to automatically shift the same relative to the stone slab between the first and second angular positions to form the inside corner in the stone slab.

9. A method as set forth in claim 1, including:

forming both of the mutually angled straight cuts in the stone slab before forming the arcuate portion of the inside corner.

10. A method as set forth in claim 1, including:

positioning the stone slab in a generally horizontal orientation during the formation of the straight and arcuate portions of the inside corner in the stone slab.

11. A method as set forth in claim 1, wherein:

said advancing the cup-shaped cutting blade step comprises tilting the cup-shaped cutting blade around 30 degrees from the vertical to define the second angular position, and vertically moving the tilted cup-shaped cutting blade into and through the horizontal stone slab to define an arcuate plunge cut.

12. A method as set forth in claim 1, wherein:

said straight cuts forming step comprises sequentially forming the two mutually angled straight cuts through the stone slab.

13. In a method for making stone countertops and the like of the type using an articulated rotary drive adapted for axially rotating an associated tool with respect to a stationary stone slab, the improvement comprising:

fabricating a rigid cutting tool shank having an outer end thereof, and an inner end thereof shaped for detachable mounting in the rotary drive and rotating axially therewith;

fabricating a cup-shaped cutting blade configured to make arcuate cuts through the stone slab, with a frusto-conical sidewall which is inclined radially outwardly from the shank and includes an outer marginal edge with a plurality of axially protruding cutting teeth, and a plurality of cutting pads embedded in the sidewall and protruding radially outwardly from an outside surface of the sidewall and radially inwardly from an inside surface of the sidewall;

fixedly mounting the cup-shaped cutting blade on the outer end of the shank;

forming two mutually angled straight cuts through the stone slab to define straight portions of an inside corner in the stone slab;

detachably mounting the inner end of the shank in the rotary drive for rotation therewith; and shifting the cup-shaped cutting blade to a location generally aligned with an intersection point of the mutually angled straight cuts, and advancing the same into and through the stone slab with the sidewall oriented generally perpendicular to a face of the stone slab to cut an arcuate portion of the inside corner therein with reduced waste.

14. A method as set forth in claim 13, including:

after said cup-shaped cutting blade shifting step, linearly oscillating the cup-shaped cutting blade back and forth along the inside corner in the stone slab to ensure smooth transition areas between the straight portions and the arcuate portion of the inside corner.

15. A method as set forth in claim 14, including:

providing a computer numerical control (CNC) device, and operably connecting the CNC with the rotary drive to automatically shift the same relative to the stone slab between the first and second angular positions to form the inside corner in the stone slab.

16. A method as set forth in claim 15, including:

forming both of the mutually angled straight cuts in the stone slab before forming the arcuate portion of the inside corner.

17. A method as set forth in claim 16, including:

positioning the stone slab in a generally horizontal orientation during the formation of the straight and arcuate portions of the inside corner in the stone slab.

18. A method as set forth in claim 17, wherein:

said cup-shaped cutting blade shifting step comprises tilting the cup-shaped cutting blade around 30 degrees from the vertical to define the second angular position, and vertically moving the tilted cup-shaped cutting blade into and through the horizontal stone slab to define an arcuate plunge cut.

19. A method as set forth in claim 18, wherein:

said straight cuts forming step comprises sequentially forming the two mutually angled straight cuts through the stone slab.

20. A method as set forth in claim 13, including:

providing a computer numerical control (CNC) device, and operably connecting the CNC with the rotary drive to automatically shift the same relative to the stone slab between the first and second angular positions to form the inside corner in the stone slab.

21. A method as set forth in claim 13, including:

forming both of the mutually angled straight cuts in the stone slab before forming the arcuate portion of the inside corner.

22. A method as set forth in claim 13, including:

positioning the stone slab in a generally horizontal orientation during the formation of the straight and arcuate portions of the inside corner in the stone slab.

23. A method as set forth in claim 13, wherein:

said cup-shaped cutting blade shifting step comprises tilting the cup-shaped cutting blade around 30 degrees from the vertical to define the second angular position, and vertically moving the tilted cup-shaped cutting blade into and through the horizontal stone slab to define an arcuate plunge cut.

24. A method as set forth in claim 13, wherein:

said straight cuts forming step comprises sequentially forming the two mutually angled straight cuts through the stone slab.

25. In a method for making a countertop from a stone slab, the improvement comprising:

cutting two mutually angled straight cuts through the stone slab to define straight portions of an inside corner in the stone slab;

providing a rotary drive adapted for axially rotating an associated tool with respect to the stone slab;

fabricating a rigid cutting tool shank having an outer end thereof, and an inner end thereof shaped for detachable mounting in the rotary drive and rotating axially therewith;

fabricating a cup-shaped cutting blade configured to make an arcuate cut through the stone slab, with a frusto-conical sidewall which is inclined radially outwardly from the shank and includes an outer marginal edge with a plurality of axially protruding cutting teeth, and a plurality of cutting pads embedded in the sidewall and protruding radially outwardly from an outside surface of the sidewall and radially inwardly from an inside surface of the sidewall;

mounting the cup-shaped cutting blade on the outer end of the shank;

mounting the inner end of the shank in the rotary drive for rotation therewith;

shifting the rotary drive to a location generally aligned with an intersection point of the mutually angled straight cuts, advancing the cup-shaped cutting blade into and through the stone slab with the sidewall oriented generally perpendicular to the face of the stone slab, and thereby cutting an arcuate portion of the inside corner of the stone slab with reduced waste.

26. A method as set forth in claim 25, including:

after said advancing the cup-shaped cutting blade step, linearly oscillating the cup-shaped cutting blade back and forth along the inside corner in the stone slab to ensure smooth transition areas between the straight portions and the arcuate portion of the inside corner.

27. A method as set forth in claim 25, including:

providing a computer numerical control (CNC) device, and operably connecting the CNC with the rotary drive to automatically shift the rotary drive relative to the stone slab to form the inside corner in the stone slab.

28. A method as set forth in claim 25, including:

said mutually angled straight cuts forming step is performed before said arcuate portion cutting step.

29. A method as set forth in claim 25, including:

positioning the stone slab in a generally horizontal orientation during the formation of the straight and arcuate portions of the inside corner in the stone slab.

* * * * *